United States Patent [19]

Fortune

[11] 4,073,076

[45] Feb. 14, 1978

[54] SNOW PLOW BLADE GUARD

[75] Inventor: William J. Fortune, Ankeny, Iowa

[73] Assignee: Great Ideas Corporation, Des Moines, Iowa

[21] Appl. No.: 777,565

[22] Filed: Mar. 14, 1977

[51] Int. Cl.[2] ..... E01H 5/04

[52] U.S. Cl. ..... 37/42 VL; 293/49

[58] Field of Search ..... 37/42 VL, 42 R, 41, 37/46, 50, 108 A; 172/5, 26, 784, 801; 293/17, 49, 72; 104/245; 193/37, 42; 16/44

[56] References Cited

U.S. PATENT DOCUMENTS

| | | | |
|---|---|---|---|
| 2,983,058 | 5/1961 | Hertz | 293/49 X |
| 2,985,479 | 5/1961 | Ortega et al. | 293/72 X |

FOREIGN PATENT DOCUMENTS

| | | | |
|---|---|---|---|
| 624,211 | 5/1949 | United Kingdom | 37/42 R |

*Primary Examiner*—E. H. Eickholt

*Attorney, Agent, or Firm*—Zarley, McKee, Thomte, Voorhees & Sease

[57] ABSTRACT

The lower outside edge of a snow plow blade includes an outwardly extending spring loaded arm having a roller on its outer end for engagement with street curbs. The arm is adapted to swing horizontally. The roller is offset from the center line of the arm to vary the height of the roller when the arm is rotated relative to the blade.

10 Claims, 6 Drawing Figures

SNOW PLOW BLADE GUARD

BACKGROUND OF THE INVENTION

Blades on snow plows are often times damaged by street curbs, particularly when a driveway is crossed and the edge of the snow plow is jammed into the curb. Continuous operation of the blade against the curb also substantially wears the side edge of the blade. It is not easy for the operator of the snow plow to judge the distance the blade is from the curb and ordinarily it is only when the blade actually engages the curb that the operator knows for certain what the blade's location is relative to the curb.

The present invention overcomes these problems and guards the blade against damage caused by street curbing.

SUMMARY OF THE INVENTION

A bracket is secured to the back side of the snow plow blade at the lower curb edge. An arm is connected to the bracket through springs thereby allowing the arm to pivot horizontally rearwardly of the blade as a roller on the outer end of the arm engages obstructions such as the end of the curb on either side of a driveway. Stops are provided to limit pivoting of the arm beyond reasonable spring limits. As the blade wears down from engagement from the street surface, it is desirable to position the guard at a higher elevation and thus the roller is offset from the centerline of the arm and rotation of the arm relative to the mounting bracket will position the roller upwardly.

DESCRIPTION OF THE PREFERRED EMBODIMENT

Figure 1:
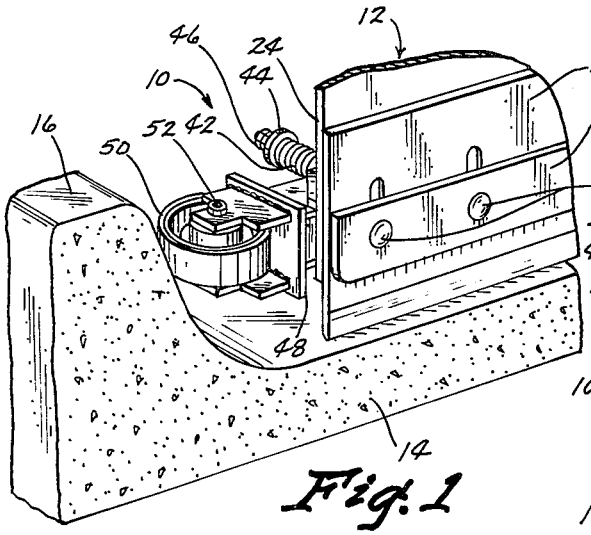
FIG. 1 is a fragmentary perspective view of the snow plow blade guard mounted on a snow plow blade and in operation on a street having a curb.
Figure 2:
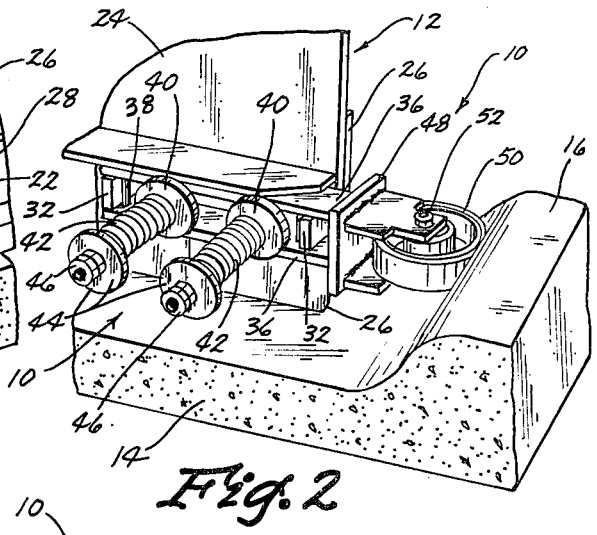
FIG. 2 is a view similar to FIG. 1, but from the rear side of the snow plow blade.
Figure 3:
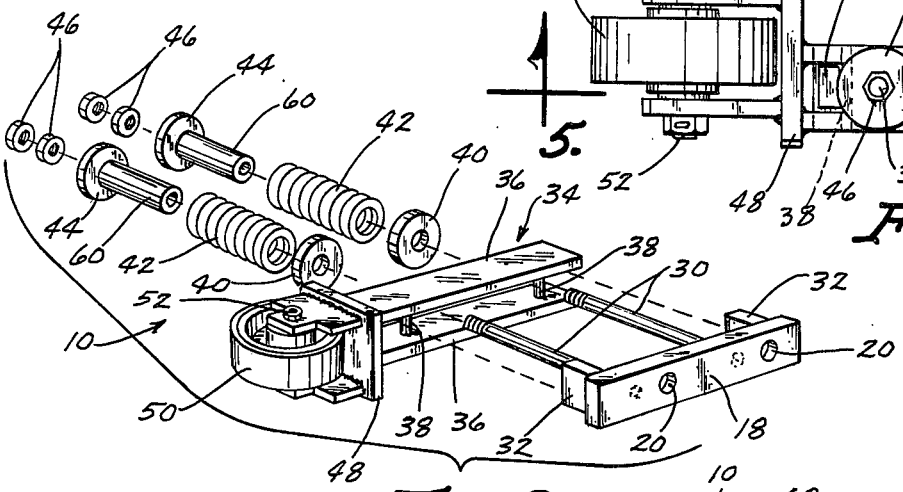
FIG. 3 is an exploded perspective view of the blade guard attachment.
Figure 4:
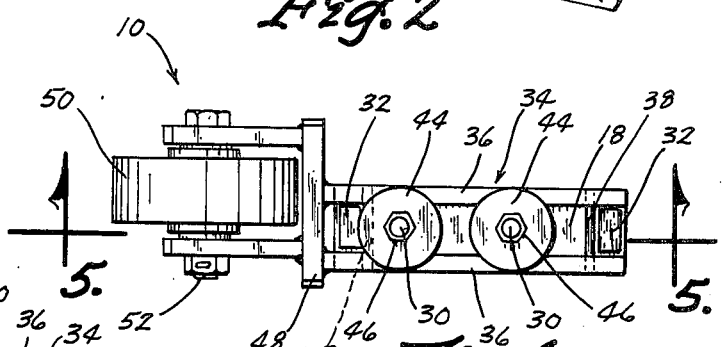
FIG. 4 is a top plan view thereof.
Figure 5:
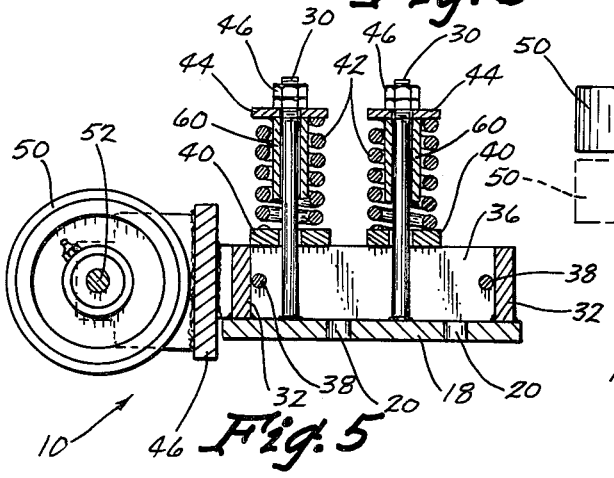
FIG. 5 is a cross-sectional view taken along 5—5 in FIG. 4.

The snow plow blade guard attachment of this invention is referred to generally in FIG. 1 by the reference numeral 10 and is shown mounted on a snow plow blade 12, working a street 14 having an upstanding curb 16.

The snow plow blade guard attachment 10 comprises a mounting bracket 18 having mounting holes 20 through which bolts 22 extend in connecting the bracket 18 to the blade 12 with the bracket 18 being mounted on the back side 24 of the snow blade 12. The mounting bolts 22 in addition to holding the bracket 18 on the blade 12, conventionally secure a vertically adjustable lower blade section 26 to the blade 12 by being clamped between the blade 12 and a mounting plate 28. The mounting bracket 18 includes rearwardly extending arm mounting bolts 30 disposed parallel to guide plates 32 spaced outwardly therefrom.

An arm 34 is mounted on the bolts 30 which extend between spaced apart arm plates 36. The guides 32 are positioned against pin 38 extending between the arm plates 36. The bracket 18 is of such a size that it extends over the edges of the arm plates 36 and abuts thereagainst. On the side of the arm plates 36 opposite the bracket 18 and mounted on the bolts 30, are washers 40, springs 32 and washers 44 against which lock nuts 46 are positioned. The springs 42 are compressed between the arm plates 36 and the outer washers 44 as the arm is pivoted away from the bracket 18.

The outer end of the arm plates 36 are interconnected by an end plate 48 on which a roller 50 is rotatably mounted for rotation about a vertical axis 52.

Figure 6:
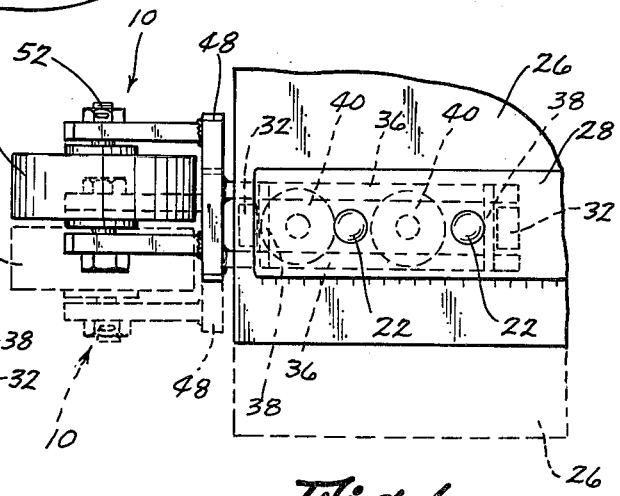
FIG. 6 is a fragmentary front elevation view of the blade guard mounted on the snow plow blade.

In FIG. 6 it is seen that the end plate 48 with the roller 50 is mounted in an offset manner relative to the longitudinal axis of the arm 34 such that when the arm 34 is turned in one direction, the roller 50 assumes a solid line raised position and when it is turned in the opposite direction, it is lowered to the dash line position, thereby allowing for the roller to be lowered.

In operation, it is seen that the snow plow blade guard 10 of this invention may be mounted on a conventional snow plow blade 12 by removal of the existing bolts 22 and adding the mounting bracket 18 on the back side thereof, such that the bracket becomes immovably attached to the blade 12. The arm 34 is now spring loaded by its connection to the bracket 18 through the springs 42 and may pivot rearwardly when an obstruction such as the end of a driveway curb is hit by the roller 50. The rearward pivotal movement is limited by the stop sleeves 60 mounted on the bolts 30 when the inner ends of the sleeves 60 engage the washers 40 positioned against the arm plates 36. Damage to the springs 42 is prevented and an unreasonable amount of pivoting is avoided. The guide plates 32 maintain the package assembly during its operation. As noted, when the lower blade section 26 is new, it will extend to the dash line position in FIG. 6 and the blade guard 10 would be mounted in its lower dash line position. After the lower blade section has worn down to the solid line position, the blade guard attachment is then rotated 180° thereby positioning the roller 50 vertically upwardly to the solid line position whereby engagement with the curb 16 is maintained at a uniform height, neither too low nor too high.

What is claimed is:

1. A snow plow blade comprising, an upstanding blade having a lower edge and opposite end edges, a blade guard connected to said blade extending horizontally outwardly of one of said ends of said blade, spring means operatively connected between said blade and said guard for allowing said guard to yieldably move horizontally upon engagement with an obstruction outwardly of said one end of said blade, and said guard including a horizontally extending arm connecting it to a mounting bracket connected to said blade, and said bracket including bolt means with said spring means being mounted thereon operatively engaging said arm.

2. The structure of claim 1 wherein said bolt means extends through said arm and said spring means are mounted between the outer end of said bolt means and said arm.

3. The structure of claim 2 wherein said arm and bracket include cooperating guide means to maintain relative alignment therebetween.

4. The structure of claim 3 wherein said arm and bracket include stop means to limit movement of said guard relative to said blade.

5. The structure of claim 4 wherein said guard includes a roller on its outer end for engagement with an obstruction.

6. A snow plow blade comprising, an upstanding blade having a lower edge and opposite end edges, a blade guard connected to the back side of said blade extending horizontally outwardly of one of said ends of said blade, said blade limiting said blade guard against forward pivotal movement, and spring means operatively connected between said blade and said guard for allowing said guard to yieldably move horizontally rearwardly only, upon engagement with an obstruction outwardly of said one end of said blade.

7. The structure of claim 6 wherein a stop means is provided on said blade and includes a portion in the travel path of said blade guard to limit rearward pivoting of said blade guard to a predetermined distance against the action of said spring means.

8. The structure of claim 6 wherein said guard includes a roller on its outer end for engagement with an obstruction.

9. The structure of claim 8 wherein said roller is mounted for rotation about a vertical axis.

10. The structure of claim 6 wherein said blade guard includes a horizontally extending arm connecting it to said blade and said guard is vertically offset from the centerline of said arm whereby said guard may be selectively vertically spaced by rotation of said arm about its longitudinal axis when being secured to said blade.

* * * * *